US011134777B2

(12) United States Patent
Knapp et al.

(10) Patent No.: US 11,134,777 B2
(45) Date of Patent: Oct. 5, 2021

(54) CUBICLE SCREEN

(71) Applicant: CKnapp Sales, Inc., Goodfield, IL (US)

(72) Inventors: Chance Knapp, Goodfield, IL (US); Micah Fehr, Danvers, IL (US)

(73) Assignee: CKnapp Sales, Inc., Goodfield, IL (US)

( * ) Notice: Subject to any disclaimer, the term of this patent is extended or adjusted under 35 U.S.C. 154(b) by 307 days.

(21) Appl. No.: 16/353,633

(22) Filed: Mar. 14, 2019

(65) Prior Publication Data

US 2020/0288867 A1 Sep. 17, 2020

(51) Int. Cl.

| | |
|---|---|
| ***A47B 96/20*** | (2006.01) |
| ***E06B 9/60*** | (2006.01) |
| ***E06B 9/42*** | (2006.01) |
| *E06B 9/40* | (2006.01) |

(52) U.S. Cl.

CPC ..... *A47B 96/20* (2013.01); *E06B 9/42* (2013.01); *E06B 9/60* (2013.01); *A47B 2200/0066* (2013.01); *A47B 2200/0085* (2013.01); *A47B 2200/12* (2013.01); *E06B 2009/402* (2013.01)

(58) Field of Classification Search

CPC ..... A47B 96/20; A47B 2200/0085; A47B 2200/12; E06B 9/42; E06B 9/60; E06B 2009/402; E04H 15/02; E04H 15/06; E04H 15/08

See application file for complete search history.

(56) References Cited

U.S. PATENT DOCUMENTS

| | | | | |
|---|---|---|---|---|
| 6,568,335 | B2 * | 5/2003 | Hamilton | A47B 17/033 108/50.02 |
| 9,506,268 | B1 * | 11/2016 | Bright | E04H 15/58 |
| 2008/0211361 | A1 * | 9/2008 | Boxenbaum | A47B 51/00 312/196 |
| 2014/0246638 | A1 * | 9/2014 | Anson | E01F 13/028 256/37 |
| 2016/0123034 | A1 * | 5/2016 | Leathers | E04H 15/02 135/161 |
| 2018/0044982 | A1 * | 2/2018 | Wang | E06B 9/08 |
| 2019/0063018 | A1 * | 2/2019 | Reiner | B65H 75/4471 |

* cited by examiner

*Primary Examiner* — Daniel P Cahn
*Assistant Examiner* — Poras Pradipkumar Patel
(74) *Attorney, Agent, or Firm* — Marshall, Gerstein & Borun LLP

(57) ABSTRACT

A cubicle screen includes a first mounting assembly, a second mounting assembly, a fabric roll, a tensioning mechanism, and a retention mechanism. The first mounting assembly has a first clamp configured to be secured to a work surface and a first mounting post secured to the first clamp. The fabric roll is positionable on the first mounting post and has an inner tube and a fabric rolled about the inner tube. The tensioning mechanism is adapted to prevent rotation of the fabric roll about the mounting post and maintain a desired tension in the fabric. The second mounting assembly includes a second clamp configured to be secured to the work surface and a second mounting post secured to the second clamp. The retention mechanism is adapted to secure an end of the fabric to the second mounting post.

24 Claims, 11 Drawing Sheets

CUBICLE SCREEN

FIELD OF THE INVENTION

This disclosure relates generally to cubicle partitions and, more particularly, to a deployable cubicle screen that can be mounted to an existing work surface to create one or more cubicle partitions.

BACKGROUND

In some modern office settings and configurations, including so-called "open office" configurations, desks or workstations may be arranged such that multiple workers can share the same space or work area. While such arrangements are supposedly conducive to increasing productivity and communication among the multiple workers, issues arise as to privacy, noise, and otherwise lack of clear boundaries defining a worker's given workspace. Moreover, when such issues are identified in a work space, it is often difficult for a company or owner of the desks or workstations to reconfigure the desks or workstations to meet the needs of the multiple workers. Accordingly, various embodiments of a cubicle screen, adaptable to address these issues, are disclosed herein.

SUMMARY

In accordance with one exemplary aspect of the present invention, a cubicle screen includes first and second mounting assemblies, a fabric roll, a tensioning mechanism, and a retention mechanism. The first mounting assembly includes a first clamp configured to be secured to a work surface and a first mounting post secured to the first clamp. The fabric roll is positionable on the first mounting post and comprises an inner tube and a fabric rolled about the inner tube. The tensioning mechanism is adapted to prevent rotation of the fabric roll about the mounting post and maintain a desired tension in the fabric. The second mounting assembly includes a second clamp configured to be secured to the work surface and a second mounting post secured to the second clamp. The retention mechanism adapted to secure an end of the fabric to the second mounting post.

In further accordance with any one or more of the foregoing exemplary aspects of the present invention, the cubicle screen may further include, in any combination, any one or more of the following preferred forms.

In one preferred form, the first mounting post is movably secured to the first clamp and the second mounting post is movably secured to the second clamp such that a height of the cubicle screen above the work surface is adjustable.

In another preferred form, the height of the cubicle screen is adjustable between approximately 12 inches and 30 inches above the work surface.

In another preferred form, the height of the cubicle screen is adjustable in 1 inch increments.

In another preferred form, the fabric is a sound absorbing fabric.

In another preferred form, a sound absorbing panel is secured to the fabric with the fabric extending between the first mounting post and the second mounting post.

In another preferred form, the sound absorbing panel is secured to the fabric through at least one of a pin, a clamp, a clips, hook and loop type fastener, or a magnet.

In another preferred form, the tensioning mechanism comprises at least one of a gear lock, a ratchet, a crank, a clamp lock, a pin lock, or a clip lock.

In another preferred form, the tensioning mechanism comprises a gear lock. The gear lock comprises a first plurality of geared teeth on the first mounting post and a second plurality of geared teeth on the inner tube of the fabric roll, the second plurality of teeth arranged to engage the first plurality of teeth with the fabric roll installed on the first mounting post to prevent rotation of the fabric roll about the first mounting post.

In another preferred form, the tensioning mechanism comprises a rotor spring such that the fabric can be retracted by the tensioning mechanism back onto the fabric roll.

In another preferred form, the retention mechanism comprises at least one of a clamp, a clip, hook and loop type fastener, a pinned button, or a magnet.

In another preferred form, the retention mechanism comprises a textured surface on an outer surface of the second mounting post configured to engage and hold the fabric.

In another preferred form, the first mounting post is secured to the first clamp such that the first mounting post is positioned at a non-perpendicular angle to an upper surface of the work surface without tension placed on the first mounting post by the fabric and is positioned perpendicular to the upper surface of the work surface with tension placed on the first mounting post by the fabric. The second mounting post is secured to the second clamp such that the second mounting post is positioned at a non-perpendicular angle to the upper surface of the work surface without tension placed on the second mounting post by the fabric and is positioned perpendicular to the upper surface of the work surface with tension placed on the second mounting post by the fabric.

In another preferred form, a third mounting assembly including a third clamp configured to be secured to the work surface and a third mounting post secured to the third clamp.

In another preferred form, the cubicle screen has a height of approximately 18 inches above the work surface.

In another preferred form, the first claim comprises a low profile clamp having a first plate positioned adjacent an upper surface of the work surface, a second plate positioned adjacent a lower surface of the work surface, and a threaded member threaded through the first plate and the second plate.

In accordance with another exemplary aspect of the present invention, a method of installing a cubicle screen includes the steps of securing a first clamp of a first mounting assembly to the work surface, the first mounting assembly including a first mounting post secured to the first clamp; securing a second clamp of a second mounting assembly to the work surface, the second mounting assembly including a second mounting post secured to the second clamp; positioning a fabric roll, comprising an inner tube and a fabric rolled about the inner tube, on the first mounting post; unrolling a portion of the fabric from the fabric roll and securing an end of the fabric to the second mounting post; pulling the fabric to a desired tension; and preventing rotation of the fabric roll about the first mounting post with a tensioning mechanism to maintain the desired tension in the fabric.

In further accordance with any one or more of the foregoing exemplary aspects of the present invention, the method of installing a cubicle screen may further include, in any combination, any one or more of the following preferred forms.

In one preferred form, the first clamp is secured to one of a side or a corner of the work surface.

In another preferred form, the second clamp is secured to one of a side or a corner of the work surface.

In another preferred form, the method comprises the steps of adjusting the position of the first mounting post on the first clamp and adjusting the position of the second mounting post on the second clamp to adjust a height of the cubicle screen above the work surface.

In another preferred form, the fabric is a sound absorbing fabric.

In another preferred form, the method comprises the step of installing a sound absorbing panel to the fabric with the fabric extending between the first mounting post and the second mounting post.

In another preferred form, the portion of the fabric unrolled from the fabric roll is positioned to extend along an edge of the work surface.

In another preferred form, the portion of the fabric unrolled from the fabric roll is positioned to extend across a top surface of the work surface.

In another preferred form, preventing rotation of the fabric roll comprises aligning a first plurality of geared teeth on an external surface of the first mounting post with a second plurality of geared teeth on an internal surface of the inner tube and positioning the inner tube on the first mounting post such that the first plurality of geared teeth engage the second plurality of geared teeth.

In another preferred form, the end of fabric is secured to the second mounting post with at least one of a clamp, a clip, hook and loop type fastener, a pinned button, or a magnet.

In another preferred form, the first mounting post is secured to the first clamp such that the first mounting post is positioned at a non-perpendicular angle to an upper surface of the work surface without tension placed on the first mounting post by the fabric and is positioned perpendicular to the upper surface of the work surface with tension placed on the first mounting post by the fabric. The second mounting post is secured to the second clamp such that the second mounting post is positioned at a non-perpendicular angle to the upper surface of the work surface without tension placed on the second mounting post by the fabric and is positioned perpendicular to the upper surface of the work surface with tension placed on the second mounting post by the fabric.

In another preferred form, the method comprises the steps of securing a third clamp of a third mounting assembly to the work surface, the third mounting assembly including a third mounting post secured to the third clamp and extending the fabric around the third mounting post between the fabric roll and the second mounting post.

BRIEF DESCRIPTION OF THE DRAWINGS

The Figures described below depict various aspects of the systems, devices, and/or methods disclosed therein. It should be understood that each Figure depicts an embodiment of a particular aspect of the disclosed systems, devices, and/or methods, and that each of the Figures is intended to accord with a possible embodiment thereof. Further, wherever possible, the following description refers to the reference numerals included in the following Figures, in which features depicted in multiple Figures are designated with consistent reference numerals.

There are shown in the drawings arrangements which are presently discussed, it being understood, however, that the present embodiments are not limited to the precise arrangements and instrumentalities shown, wherein.

Figure 1:
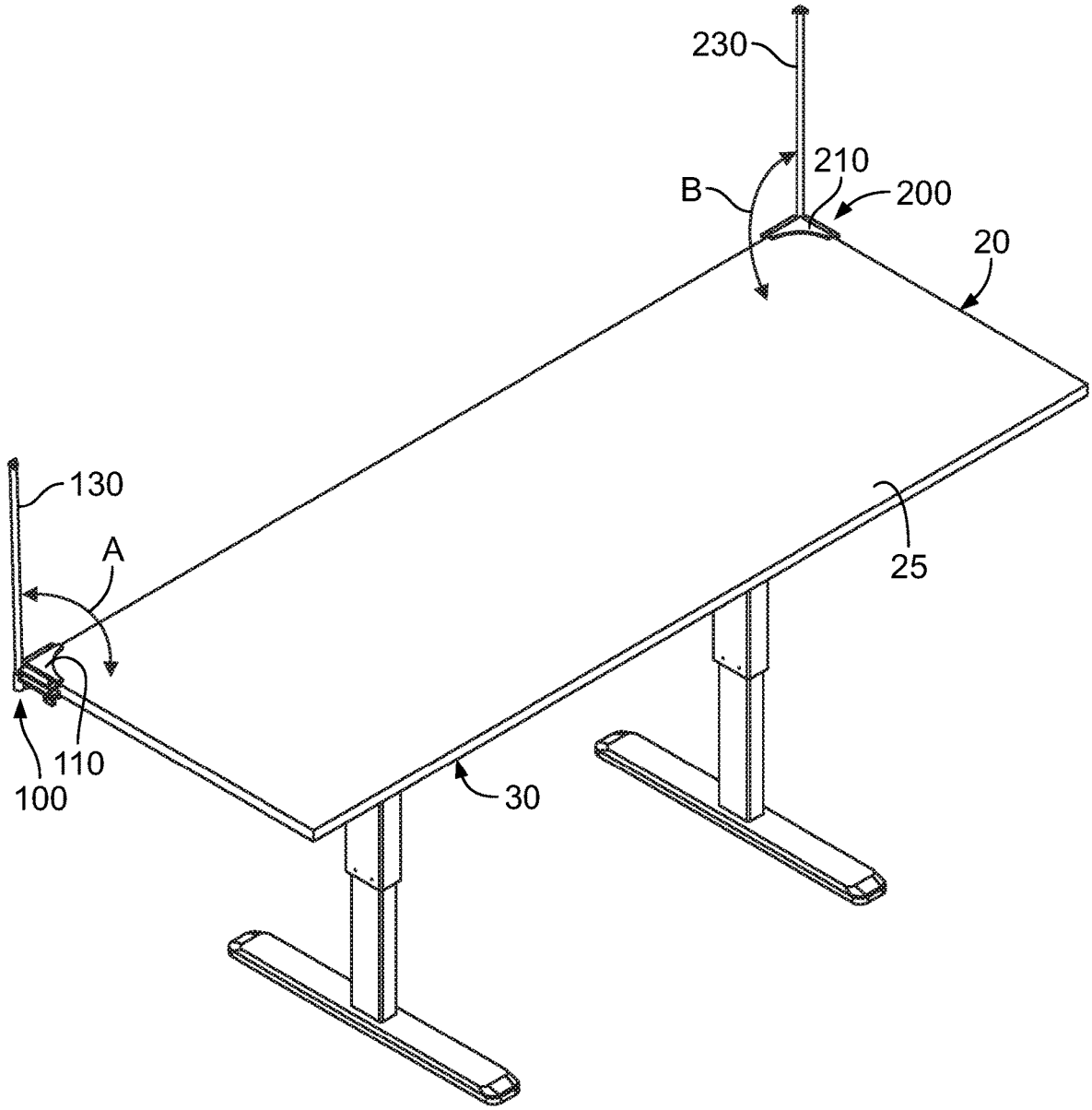
FIG. 1 is a perspective view of an example cubicle screen installed along an edge of a work surface, with the fabric roll removed.
Figure 2:
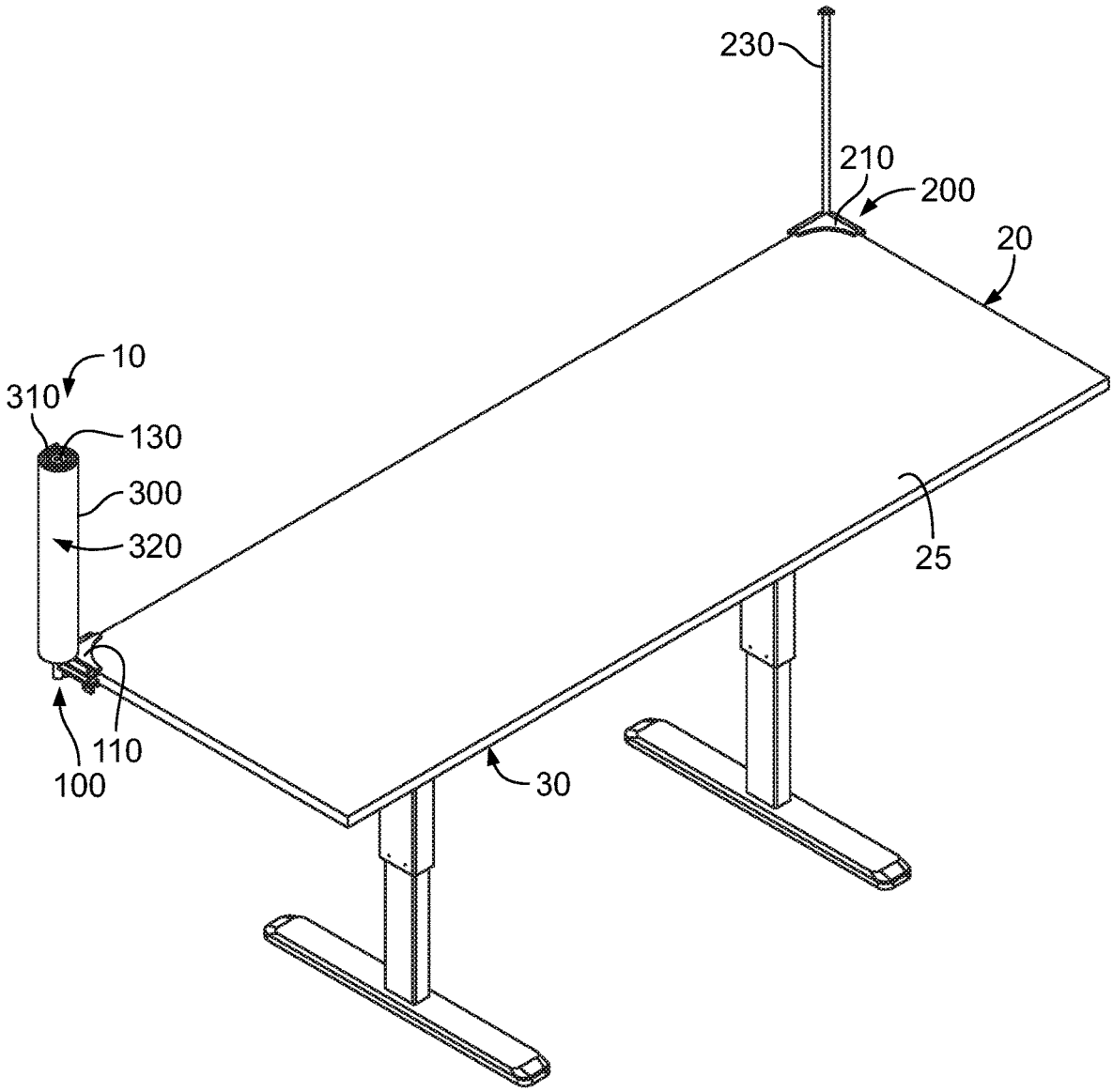
FIG. 2 is a perspective view of the cubicle screen of FIG. 1 in a retracted position.
Figure 3:
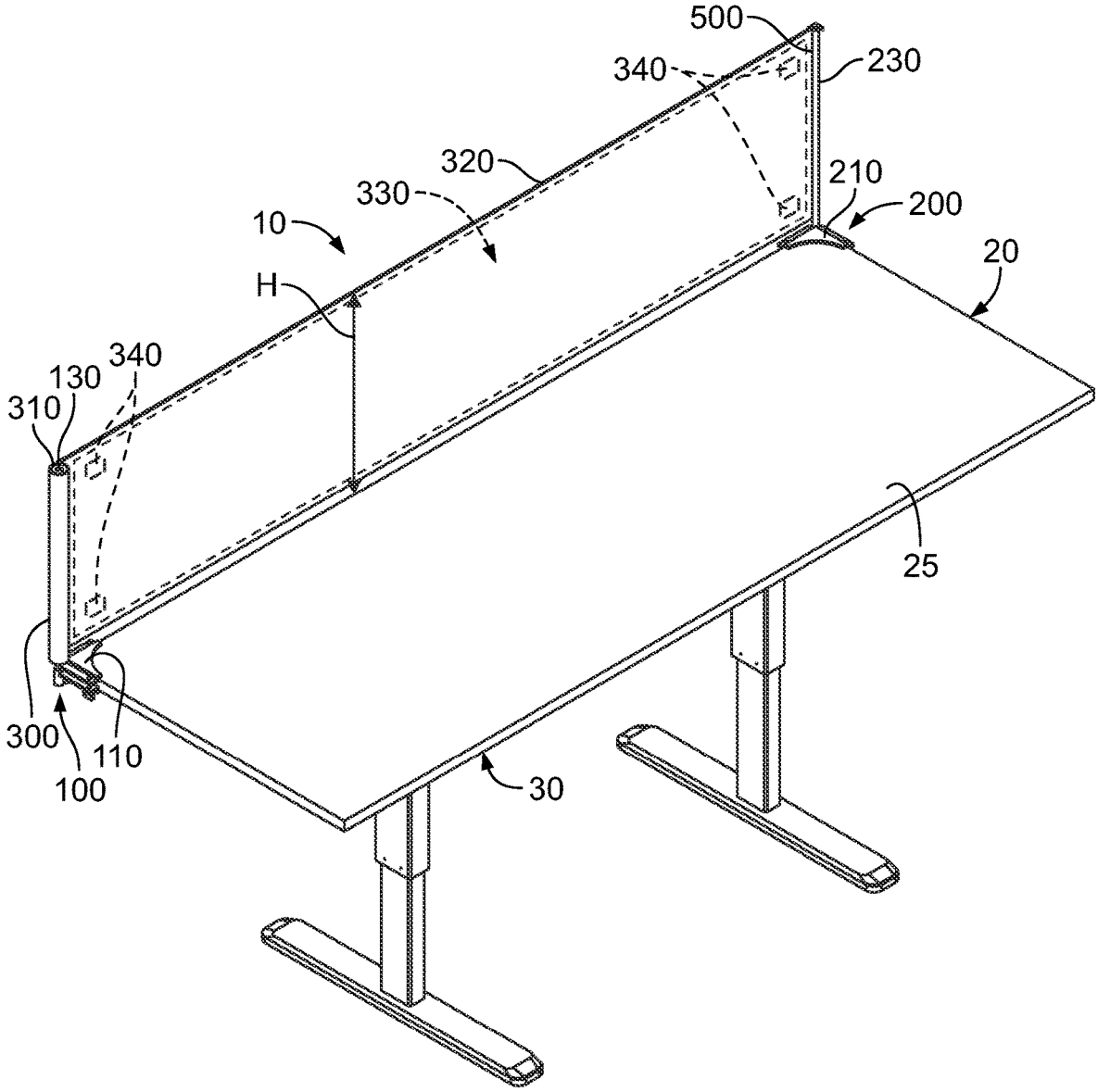
FIG. 3 is a perspective view of the cubicle screen of FIG. 2 in an extended position.

The Figures depict preferred embodiments for purposes of illustration only. Alternative embodiments of the systems and methods illustrated herein may be employed without departing from the principles of the invention described herein.

DETAILED DESCRIPTION

FIGS. 1-4 illustrate one example cubicle screen 10 that can be mounted on any type of work surface 20, such as the working surface of a table, desk, etc., to function as a cubicle partition and provide some measure of privacy and/or noise attenuation for a user of work surface 20. Cubicle screen 10 generally includes a first mounting assembly 100, a second mounting assembly 200, a fabric roll 300, a tensioning mechanism 400, and a retention mechanism 500.

First mounting assembly 100 includes a first clamp 110 that is configured to be secured to work surface 20. A first mounting post 130 is secured to first clamp 110 and extends above upper surface 25 of work surface 20. First mounting post 130 can be secured in any manner desired, such as by a bracket, adhesive, sonic welding, insertion into an aperture in first clamp 110, etc., or, alternatively, can be formed integral with first clamp 110.

First mounting post 130 can be fixedly secured to first clamp 110 so that a height H of cubicle screen 10 above upper surface 25 is fixed at a certain distance (i.e., 18 inches above upper surface 25 of work surface 20) or can be movably secured to first clamp 110 so that the height H of cubicle screen 10 above upper surface 25 of work surface 20 is adjustable, as discussed below. Because, in the depicted embodiment, first mounting post 130 is cantilevered from first clamp 110, first mounting post 130 can also be secured to first clamp 110 so that first mounting post 130 is positioned at a non-perpendicular angle A to upper surface 25 of work surface 20 when there is no tension placed on first mounting post 130 by fabric 320 and is positioned perpendicular to upper surface 25 of work surface 20 when fabric 320 is tightened and first mounting post 130 is pulled and tension is placed on first mounting post 130 by fabric 320, which helps to keep long sections of fabric 320 between first mounting post 130 and second mounting post 230 from sagging.

In the particular example shown, first clamp 110 is a low profile clamp that "telescopes" closed around work surface 20 rather than having a set height and a threaded clamp to close the gap as does a traditional clamp. As can best be seen in FIG. 4, first clamp 110 generally has a first plate 114 positioned adjacent upper surface 25 of work surface 20 and a second plate 116 positioned adjacent lower surface 30 of work surface 20. One or more threaded members 118 are threaded through first plate 114 and second plate 116 so that rotation of threaded member 118 moves first plate 114 and second plate 116 toward each other to secure first clamp 110 to work surface 20. Alternatively, rather than threading through first and second plates 114, 116, a bolt can be inserted through apertures in first and second plates 114, 116 and a nut threaded onto the bolt to tighten first and second plates 114, 116 around work surface 20.

Similarly, second mounting assembly 200 also includes a second clamp 210 that is configured to be secured to work surface 20 and a second mounting post 230 secured to second clamp 210 and extending above upper surface 25 of work surface 20. Second mounting post 230 can be secured in any manner desired, such as by a bracket, tension mounting, clamp mounting, screws, adhesive, sonic welding, and/or insertion into an aperture in second clamp 210, etc., or, alternatively, can be formed integral with second clamp 210.

Second mounting post 230 can also be fixedly secured to second clamp 210 so that height H of cubicle screen 10 is fixed at a certain distance (i.e., 18 inches above upper surface 25 of work surface 20) or can be movably secured to second clamp 210 so that the height H is adjustable, as discussed below. Because second mounting post 230 is cantilevered from second clamp 210, second mounting post 230 can also be secured to second clamp 210 so that second mounting post 230 is positioned at a non-perpendicular angle B to upper surface 25 of work surface 20 when there is no tension placed on second mounting post 230 by fabric 320 and is positioned perpendicular to upper surface 25 of work surface 20 when fabric 320 is tightened and second mounting post 230 is pulled and tension is placed on second mounting post 230 by fabric 320, which helps to keep long sections of fabric 320 between first mounting post 130 and second mounting post 230 from sagging.

In addition, in the particular example shown, second clamp 210 is also a low profile clamp, as described in detail above for first clamp 110.

Fabric roll 300 has an inner tube 310 (e.g., a hollow inner tube in some embodiments) that is positionable over first mounting post 130 to support fabric roll 300. Fabric 320 is rolled about inner tube 310 and can be unrolled to extend between first and second mounting posts 130, 230. If desired, fabric 320 can be a sound absorbing fabric provide some measure of noise attenuation. Alternatively, rather than fabric 320 being a sound absorbing fabric, a sound absorbing panel 330 (shown in phantom in FIG. 3) can be secured to fabric 320 when fabric 320 is extended between first and second mounting posts 130, 230. Sound absorbing panel 330 can be secured to fabric 320 in any manner desired, such as through pins, clamps, clips, magnets, or a hook and loop type fastener, such as Velcro® (securement methods shown generally as 340 in FIG. 3).

Figure 4:
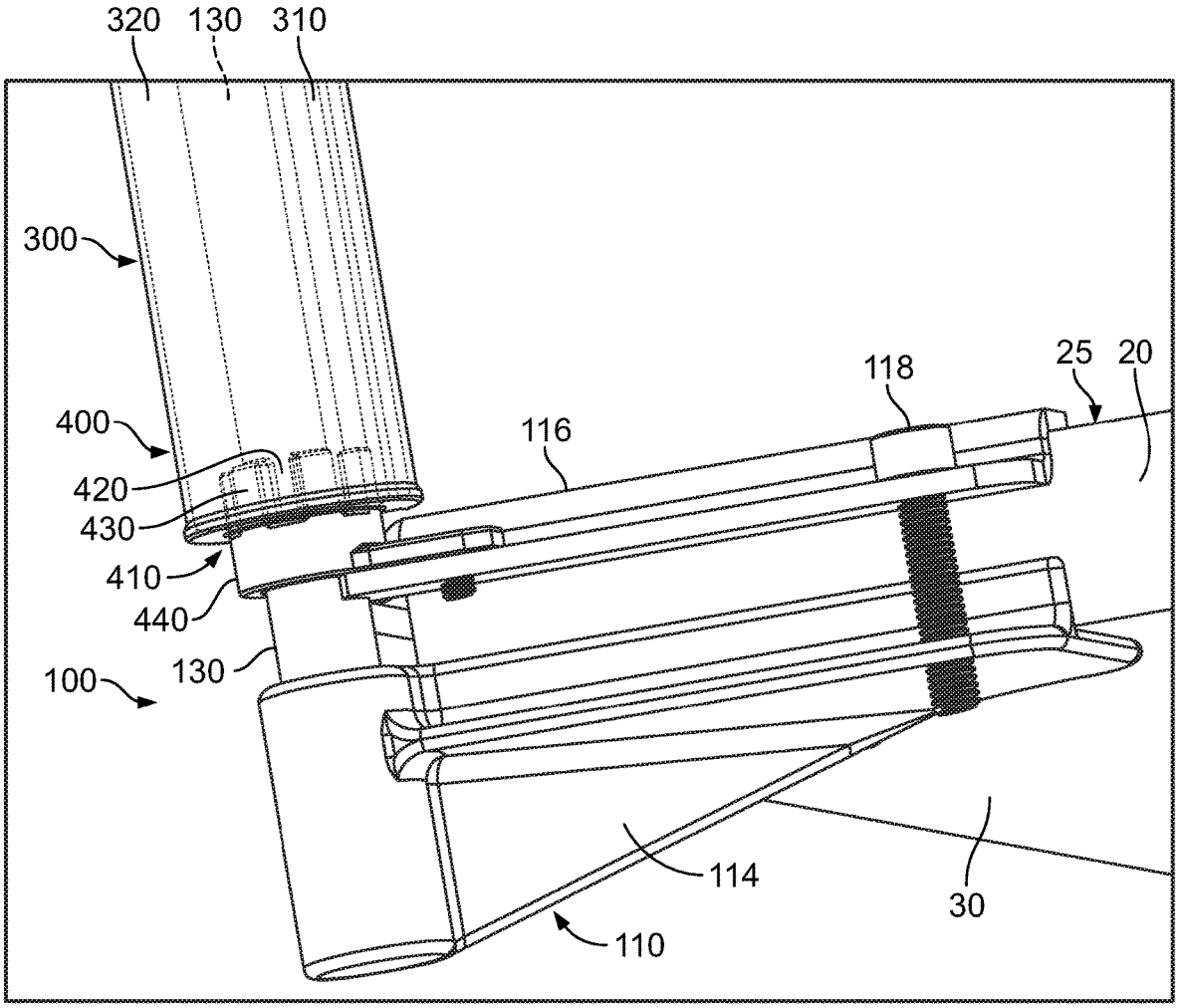
FIG. 4 is an enlarged perspective view of a clamp and mounting post of the cubicle screen of FIG. 2.

In some embodiments, tensioning mechanism 400 is provided and adapted to prevent rotation of fabric roll 300 about first mounting post 130 and to maintain a desired tension in fabric 320 and prevent sagging of fabric 320 when extended. As can best be seen in FIG. 4, in the particular example shown, tensioning mechanism 400 is a gear lock 410 that has geared teeth 420 on one of first clamp 110 or first mounting post 130, such as on an outer surface of first mounting post 130, and geared teeth 430 on inner tube 310 of fabric roll 300, such as on an inner surface of inner tube 310. Geared teeth 430 are arranged to engage geared teeth 420 when fabric roll 300 is installed on first mounting post 130 to prevent rotation of fabric roll 300 about first mounting post 130. As shown in FIG. 4, geared teeth 420 are arranged on a bracket 440 fixedly secured to first plate 114 of first clamp 110, such as by a threaded member, but geared teeth 420 can also be formed directly on first plate 114 of first clamp 110 or directly on the outer surface of first mounting post 130.

Alternatively, rather than gear lock 410, tensioning mechanism 400 can be a ratchet (e.g., a torsion spring ratchet that allows fabric roll 300 to be rotated by hand, by a handle or knob, in one direction only to create the desired tension), a crank, a clamp lock (e.g., a clamp that clamps fabric roll 300 to first mounting post 130 or some other stationary object), a pin lock (e.g., a pin that pins fabric 320 to fabric roll 300 such that fabric roll 300 cannot rotate and fabric 320 cannot be unrolled from fabric roll 300), a clip lock (e.g., a clip placed on fabric roll 300 tying fabric roll 300 to first mounting post 130 or some other stationary object), or any other mechanism desired that can secure fabric roll 300 to first mounting post 130.

Tensioning mechanism 400 can also be a rotor spring that allows fabric 320 to be retracted by tensioning mechanism 400 back onto fabric roll 300. The rotor spring creates torsion about the central axis of fabric roll 300 to make it self-retracting. In addition, once the end of fabric 320 is secured to second mounting post 230, the torsion from the rotor spring will create tension in fabric 320.

Retention mechanism 500 is provided and adapted to secure an end of fabric 320 to second mounting post 230 when fabric 320 is extended from fabric roll 300. Retention mechanism 500 can be a clamp or clip that secures fabric 320 around/to second mounting post 230, a pinned button such as a pushpin through the front side of fabric 320 that attached to a button on the back side of fabric 320 and snaps to a corresponding button receiver on second mounting post 230, a magnet, or a hook and loop type fastener, such as Velcro®, that is secured to both the end of fabric 320 and to second mounting post 230. Alternatively, retention mechanism 500 can be a textured surface on an outer surface of second mounting post 230 that is configured to engage and hold fabric 320.

Figure 5:
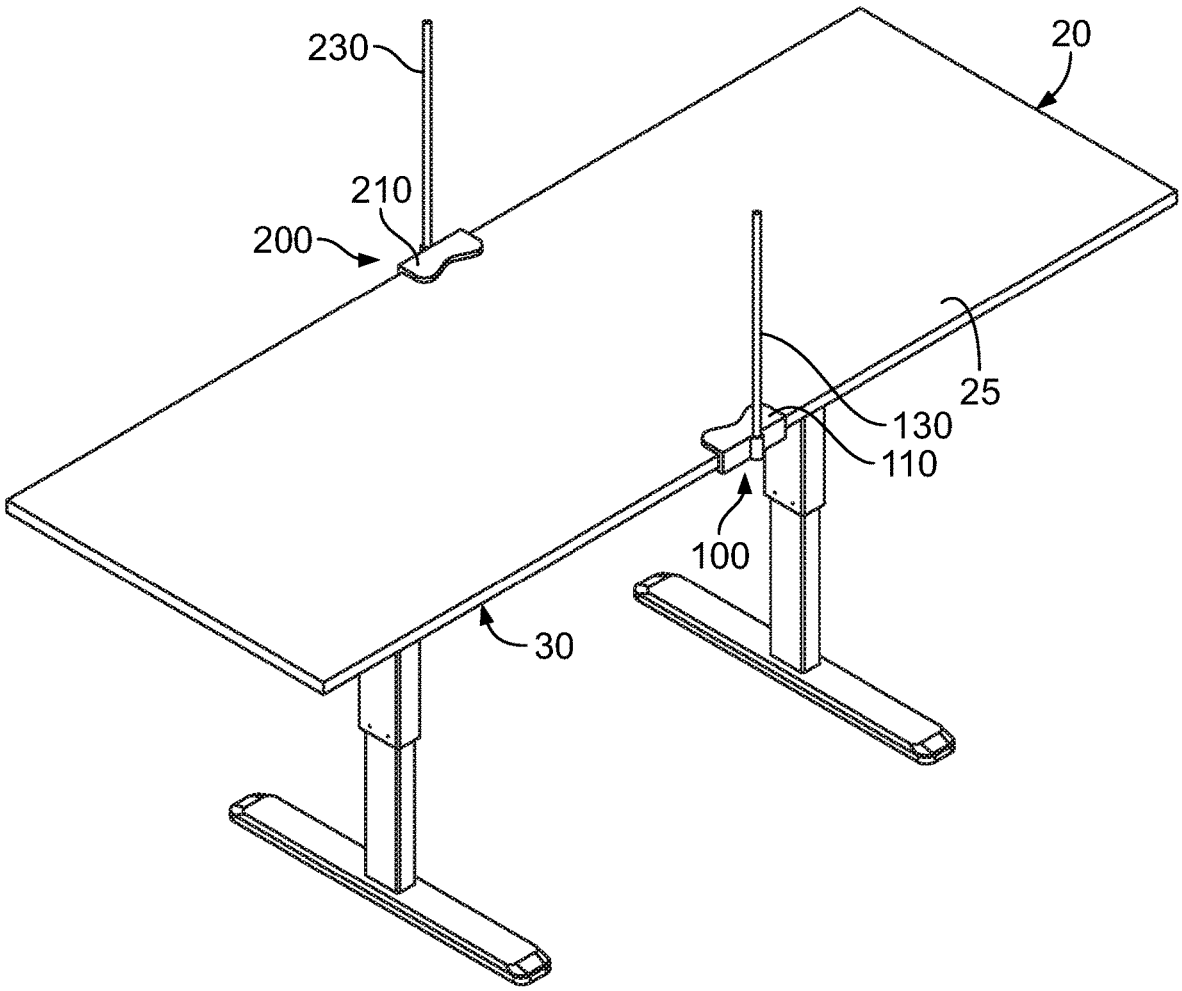
FIG. 5 is a perspective view of another example cubicle screen installed across a work surface, with the fabric roll removed.
Figure 6:
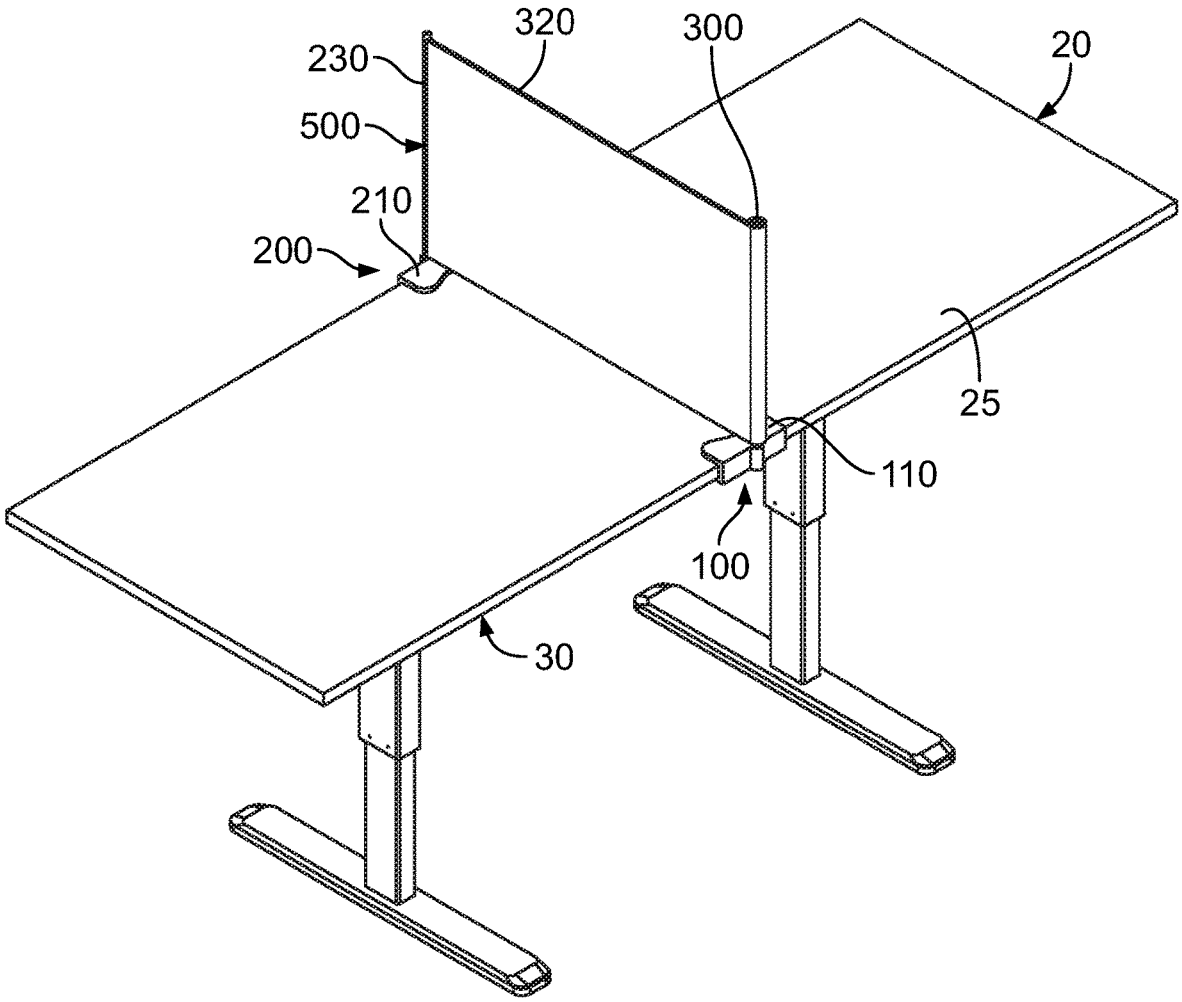
FIG. 6 is a perspective view of the cubicle screen of FIG. 5 in an extended position.

In the example shown in FIGS. 1-4, first and second clamps 110, 210 of first and second mounting assemblies 100, 200 are configured to be mounted on corners of work surface 20 so that fabric 320 extends along an edge of work surface 20. Alternatively, as shown in FIGS. 5-6, first and second clamps 110, 210 can be configured to be mounted along opposing edges of work surface 20 so that fabric 320 extends across upper surface 25 of work surface 20 to divide work surface 20 into multiple work areas.

Figure 7:
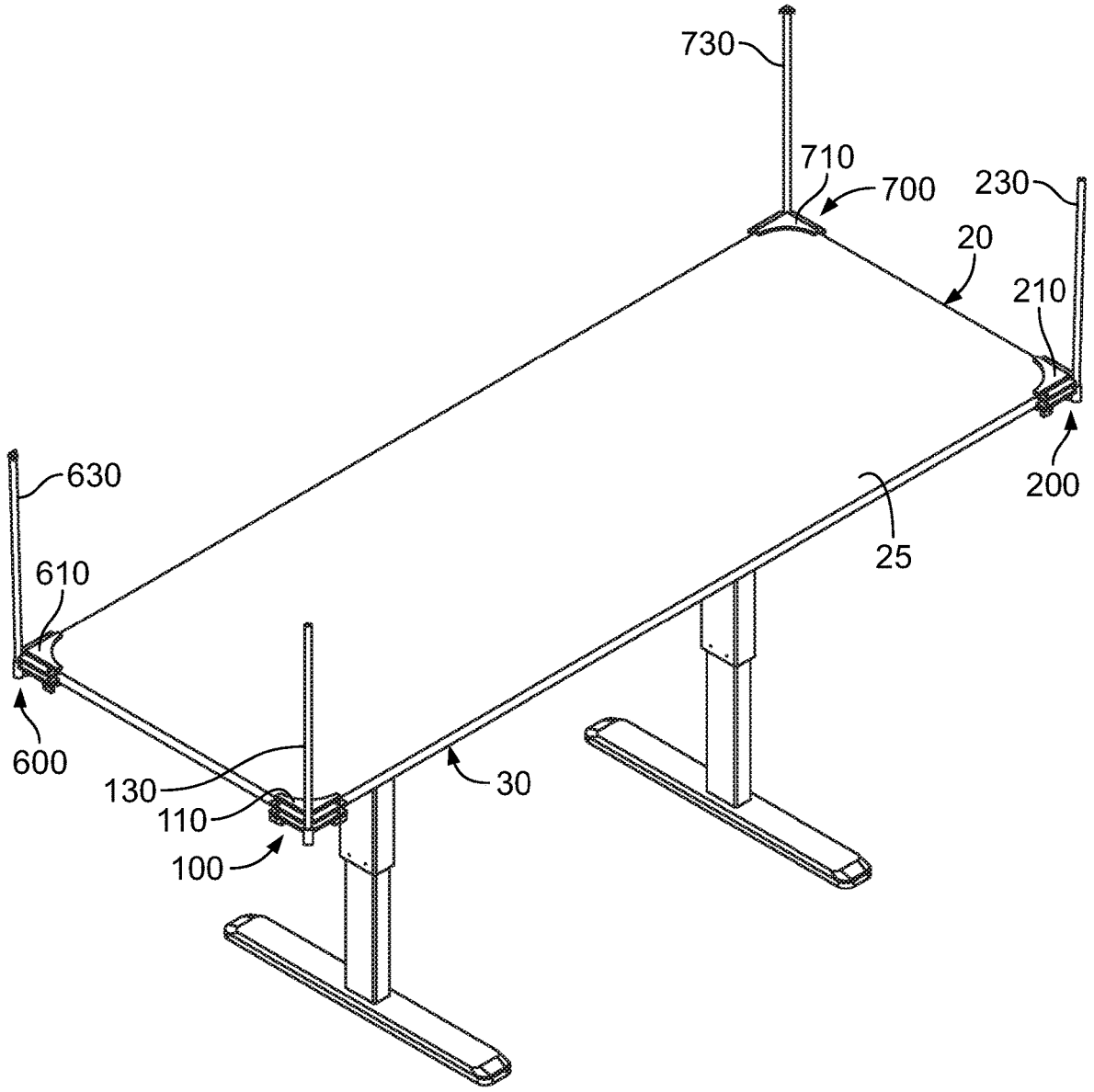
FIG. 7 is a perspective view of another example cubicle screen installed along an edge of a work surface, with the fabric roll removed.
Figure 8:
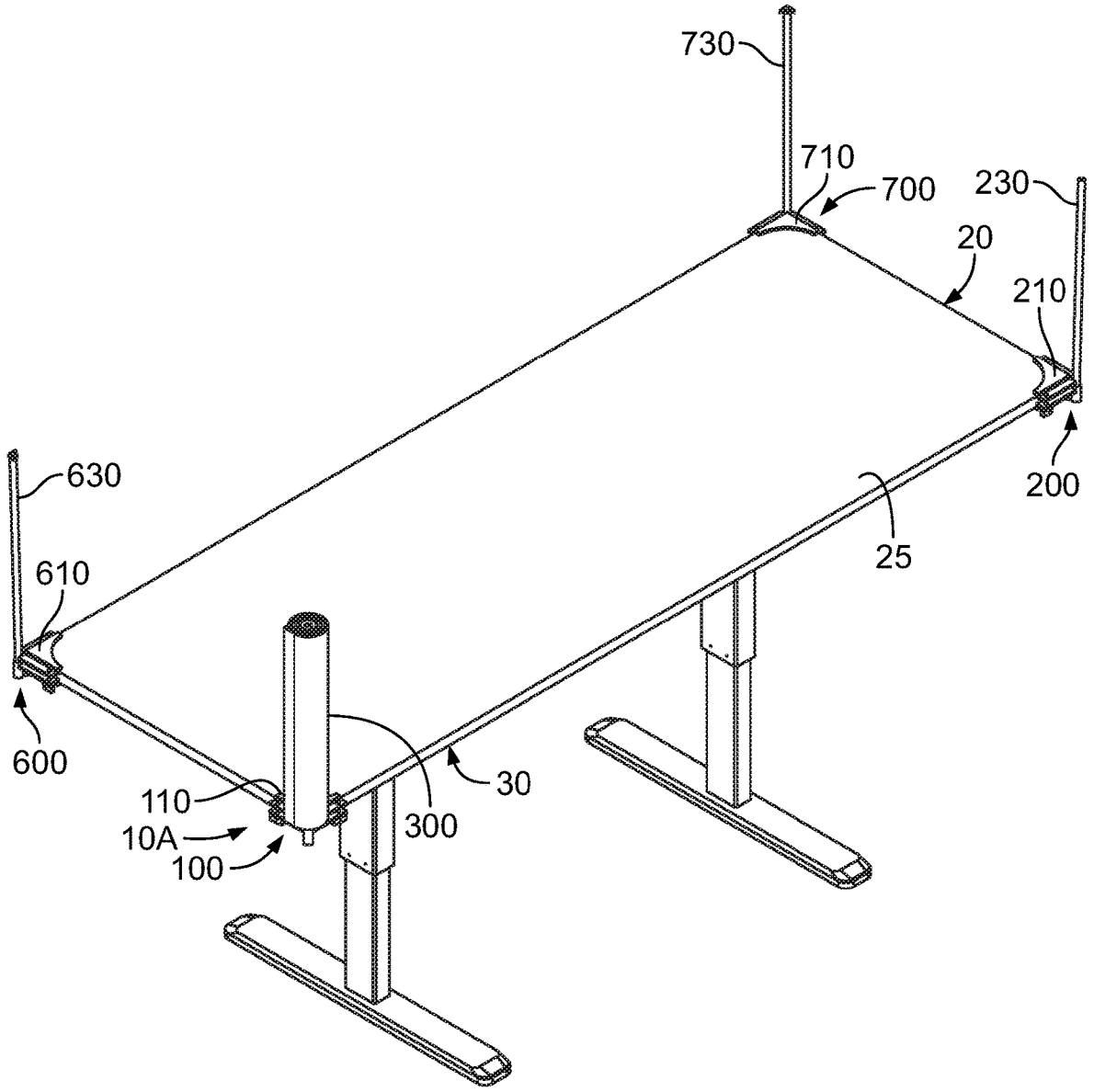
FIG. 8 is a perspective view of the cubicle screen of FIG. 7 in a retracted position.
Figure 9:
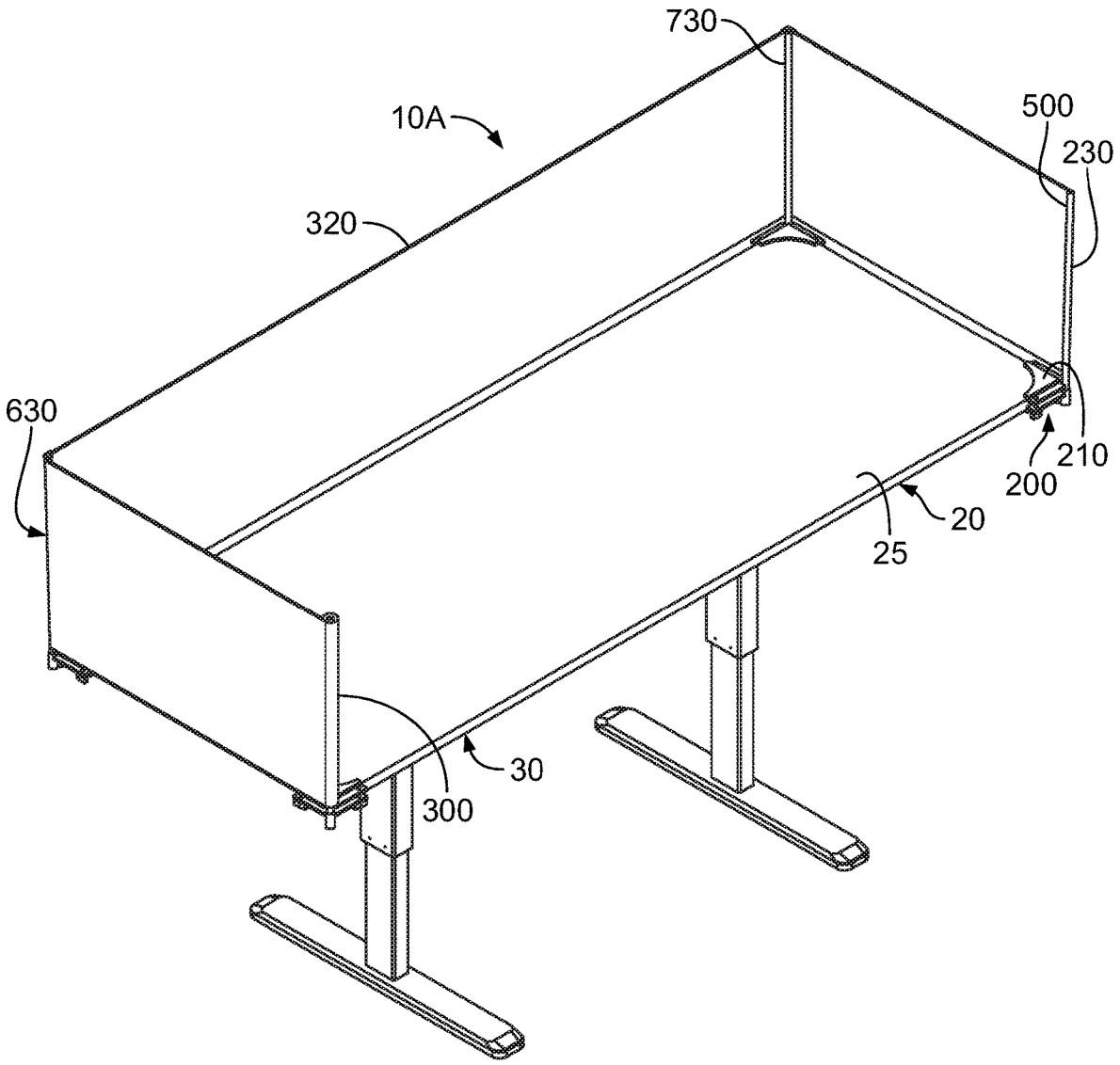
FIG. 9 is a perspective view of the cubicle screen of FIG. 8 in an extended position.

In addition, in the example shown in FIGS. 1-4, fabric 320 is extended between first mounting post 130 and second mounting post 230 along one edge of work surface 20. However, as can be seen in FIGS. 7-9, another example cubicle screen 10A can also include a third mounting assembly 600 having a third clamp 610 configured to be secured to work surface 20 and a third mounting post 630 secured to a third clamp 610 and even a fourth mounting assembly 700 having a fourth clamp 710 configured to be secured to work surface 20 and a fourth mounting post 730 secured to a fourth clamp 710, so that fabric 320 can be extended around third and fourth mounting posts 630, 730 and extend along multiple edges of the perimeter of work surface 20. Cubicle screen 10A can have any desired number of mounting assemblies to provide the necessary support for fabric 320 and to extend along the desired areas or perimeter of work surface 20.

Figure 10:
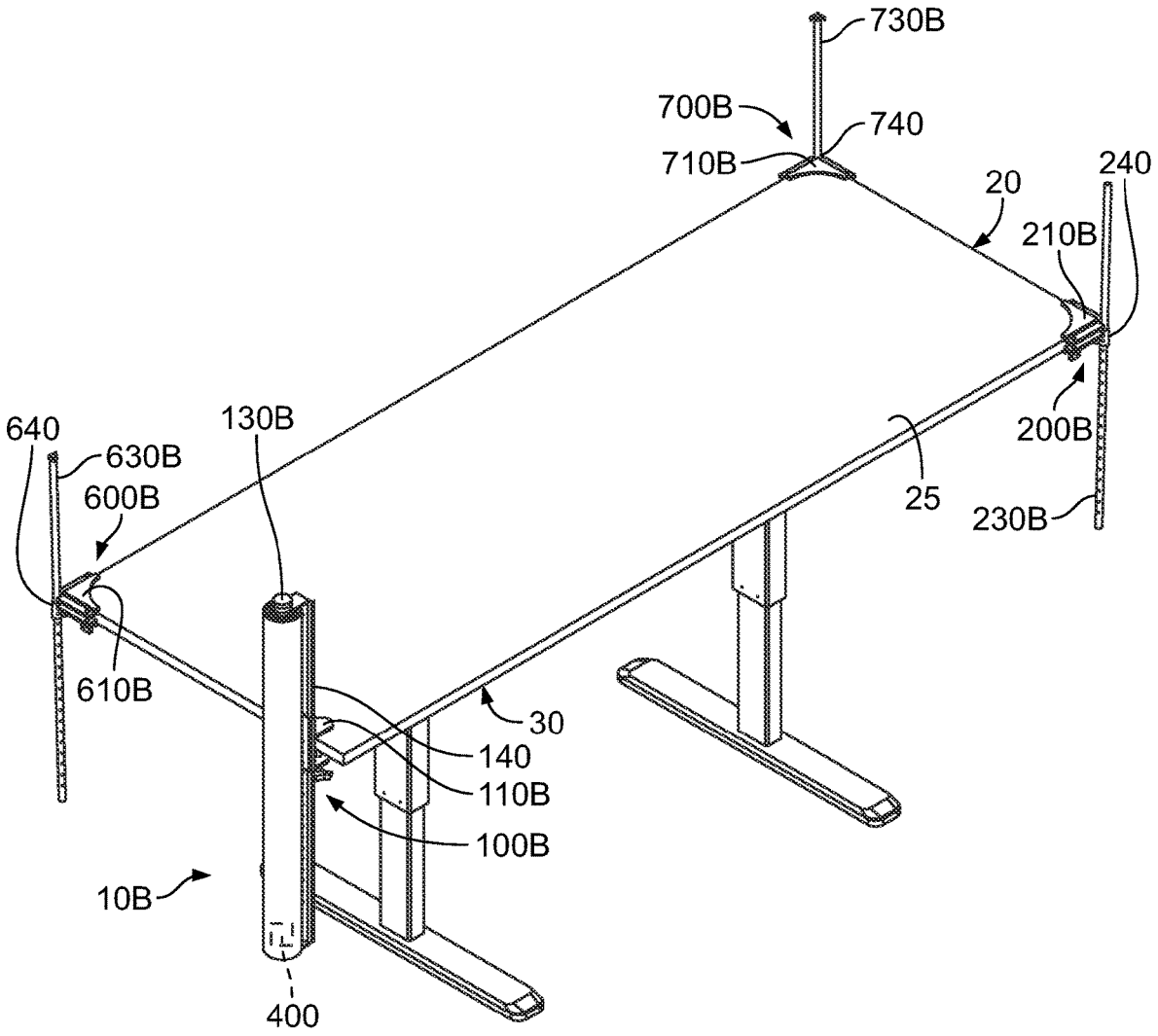
FIG. 10 is a perspective view of another example cubicle screen with adjustable mounting posts.
Figure 11:
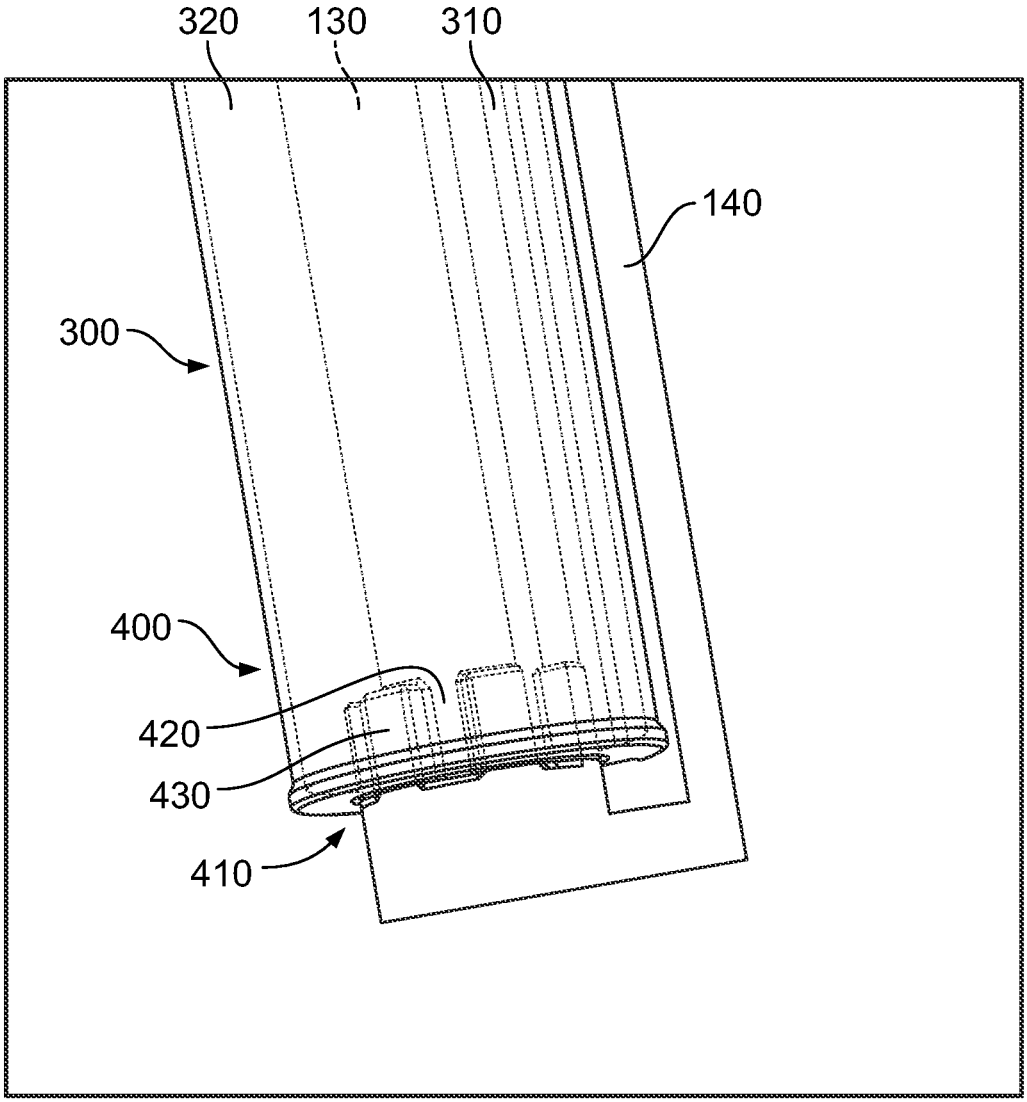
FIG. 11 is an enlarged perspective schematic representation of a mounting bracket and mounting post of the cubicle screen of FIG. 10.

As mentioned above, rather than the height H of cubicle screen 10 above upper surface 25 being fixed at a certain distance (i.e., 18 inches above upper surface 25 of work surface 20), the mounting posts can be movably secured to the clamps so that the height H of cubicle screen 10 above upper surface 25 of work surface 20 is adjustable. For example, another example cubicle screen 10B is shown in FIG. 10 in which the first, second, third, and fourth mounting assemblies 100B, 200B, 600B, 700B have first, second, third, and fourth mounting posts 130B, 230B, 630B, 730B that are movably secured to first, second, third, and fourth clamps 110B, 210B, 610B, 710B through mounting brackets 140, 240, 640, 740. Mounting brackets 140, 240, 640, 740 allow the mounting posts 130B, 230B, 630B, 730B to be moved relative to the clamps 110B, 210B, 610B, 710B so that the height H of cubicle screen 10 above work surface 20 is adjustable. For example, the height H can be adjusted anywhere between 12 and 30 inches and mounting brackets 140, 240, 640, 740 can be configured so that the height H can be adjusted in 1 inch increments.

To install cubicle screen 10 to work surface 20, first clamp 110 of first mounting assembly 100 is secured to a corner or side of work surface 20 and second clamp 210 of second mounting assembly 200 is secured to another corner or side of work surface 20. If additional portions of the perimeter of work surface 20 are to be covered and additional mounting assemblies are to be used (e.g., third mounting assembly 600 and fourth mounting assembly 700 as shown in FIGS. 7-9), the additional mounting assemblies would also be secured to the appropriate corners or sides of work surface 20.

If the mounting posts are not already secured to the clamps, the mounting posts are then secured to the clamps. As discussed above, the mounting posts can be secured to the clamps such that the mounting posts are positioned at a non-perpendicular angle to upper surface 25 of work surface 20 when there is no tension placed on the mounting posts by fabric 320 so that the mounting posts are pulled and positioned perpendicular to upper surface 25 of work surface 20 when there is tension placed on the mounting posts by fabric 320.

If adjustable mounting assemblies (e.g., 1006, 200B, 600B, 700B of FIG. 10) are being used, the position of the mounting posts 130B, 230B, 630B, 730B on the clamps 1106, 210B, 610B, 710B are adjusted to set the desired height H of the cubicle screen above work surface 20.

Fabric roll 300 is then positioned on first mounting post 130 of first mounting assembly 200, a portion of fabric 320 is unrolled from fabric roll 300 and is positioned to extend along and edge or across an upper surface 25 of work surface 20, and an end of fabric 320 is secured to second mounting post 230 with retention mechanism 500. As discussed above, the end of fabric 320 can be secured to second mounting post 230 with a clamp, a clip, hook and loop type fastener, a pinned button, a magnet, etc. If additional mounting assemblies (e.g., mounting assemblies 600, 700) are being used, fabric 320 is also positioned around mounting posts 630, 730 of the additional mounting assemblies.

Once secured to second mounting post 230, fabric 320 is pulled to the desired tension, for example by rolling some fabric back onto fabric roll 300, and tensioning mechanism 400 is engaged to prevent rotation of fabric roll 300 about first mounting post 130 and maintain the tension in fabric 320. For example, geared teeth 420 on the external surface of first mounting post 130 can be aligned with geared teeth 430 on the internal surface of inner tube 310 and the inner tube 310 positioned on first mounting post 130 so that geared teeth 420 engage geared teeth 430.

If one or more sound absorbing panels 330 are being used, sound absorbing panels 330 are installed to fabric 320 once fabric 320 is tensioned and extends between first mounting post 130 and second mounting post 230.

While various embodiments have been described above, this disclosure is not intended to be limited thereto. Variations can be made to the disclosed embodiments that are still within the scope of the appended claims.

The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

The following additional considerations apply to the foregoing discussion. Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Those of ordinary skill in the art will recognize that a wide variety of modifications, alterations, and combinations can be made with respect to the above described embodiments without departing from the scope of the invention, and that such modifications, alterations, and combinations are to be viewed as being within the ambit of the inventive concept.

The patent claims at the end of this patent application are not intended to be construed under 35 U.S.C. § 112(f) unless traditional means-plus-function language is expressly recited, such as "means for" or "step for" language being explicitly recited in the claim(s).

What is claimed is:

1. A cubicle screen, comprising:

a first mounting assembly including a first clamp configured to be secured to a work surface and a first mounting post movably secured to the first clamp such that a first portion of the first mounting post extends above the work surface and a second portion of the first mounting post extends below the work surface and the first mounting post is allowed to be moved relative to the first clamp so that a height of the cubicle screen above the work surface is adjustable;

a fabric roll positionable on the first mounting post, the fabric roll comprising an inner tube and a fabric rolled about the inner tube;

a tensioning mechanism adapted to prevent rotation of the fabric roll about the first mounting post and maintain a desired tension in the fabric;

a second mounting assembly including a second clamp configured to be secured to the work surface and a second mounting post movably secured to the second clamp such that a third portion of the second mounting post extends above the work surface and a second portion of the second mounting post extends below the work surface and the second mounting post is allowed to be moved relative to the second clamp so that a height of the cubicle screen above the work surface is adjustable; and a retention mechanism adapted to secure an end of the fabric to the second mounting post.

2. The cubicle screen of claim 1, wherein the height of the cubicle screen is adjustable between approximately 12 inches and 30 inches above the work surface.

3. The cubicle screen of claim 1, wherein the height of the cubicle screen is adjustable in 1 inch increments.

4. The cubicle screen of claim 1, wherein the fabric is a sound absorbing fabric.

5. The cubicle screen of claim 1, comprising a sound absorbing panel secured to the fabric with the fabric extending between the first mounting post and the second mounting post.

6. The cubicle screen of claim 5, wherein the sound absorbing panel is secured to the fabric through at least one of a pin, a clamp, a clip, a hook and loop typo fastener, or a magnet.

7. The cubicle screen of claim 1, wherein the tensioning mechanism comprises at least one of a gear lock, a ratchet, a crank, a clamp lock, a pin lock, or a clip lock.

8. The cubicle screen of claim 1, wherein the tensioning mechanism comprises a gear lock, the gear lock comprising:

a first plurality of geared teeth on one of a mounting bracket secured to the first clamp or the first mounting post; and a second plurality of geared teeth on the inner tube of the fabric roll, the second plurality of geared teeth arranged to engage the first plurality of geared teeth with the fabric roll installed on the first mounting post to prevent rotation of the fabric roll about the first mounting post.

9. The cubicle screen of claim 1, wherein the tensioning mechanism comprises a rotor spring such that the fabric can be retracted by the tensioning mechanism back onto the fabric roll.

10. The cubicle screen of claim 1, wherein the retention mechanism comprises at least one of a clamp, a clip, a hook and loop fastener, a pinned button, or a magnet.

11. The cubicle screen of claim 1, wherein the retention mechanism comprises a textured surface on an outer surface of the second mounting post configured to engage and hold the fabric.

12. The cubicle screen of claim 1, wherein:

the first mounting post is secured to the first clamp such that the first mounting post is positioned at a non-perpendicular angle to an upper surface of the work surface without tension placed on the first mounting post by the fabric and is positioned perpendicular to the upper surface of the work surface with tension placed on the first mounting post by the fabric; and the second mounting post is secured to the second clamp such that the second mounting post is positioned at a non-perpendicular angle to the upper surface of the work surface without tension placed on the second mounting post by the fabric and is positioned perpendicular to the upper surface of the work surface with tension placed on the second mounting post by the fabric.

13. The cubicle screen of claim 1, comprising a third mounting assembly including a third clamp configured to be secured to the work surface and a third mounting post secured to the third clamp.

14. The cubicle screen of claim 1, wherein the cubicle screen has a height of approximately 18 inches above the work surface.

15. The cubicle screen of claim 1, wherein the first clamp comprises a low profile clamp having a first plate positioned adjacent an upper surface of the work surface, a second plate positioned adjacent a lower surface of the work surface, and a threaded member threaded through the first plate and the second plate.

16. A method of installing a cubicle screen to a work surface, comprising the steps of:

securing a first clamp of a first mounting assembly to the work surface, the first mounting assembly including a first mounting post movably secured to the first clamp such that a first portion of the first mounting post extends above the work surface and a second portion of the first mounting post extends below the work surface and the first mounting post is allowed to be moved relative to the first clamp so that a height of the cubicle screen above the work surface is adjustable;

securing a second clamp of a second mounting assembly to the work surface, the second mounting assembly including a second mounting post movably secured to the second clamp such that a third portion of the second mounting post extends above the work surface and a second portion of the second mounting post extends below the work surface and the second mounting post is allowed to be moved relative to the second clamp so that a height of the cubicle screen above the work surface is adjustable;

adjusting a position of the first mounting post on the first clamp and adjusting a position of the second mounting post on the second clamp to adjust a height of the cubicle screen above the work surface;

positioning a fabric roll, comprising an inner tube and a fabric rolled about the inner tube, on the first mounting post;

unrolling a portion of the fabric from the fabric roll and securing an end of the fabric to the second mounting post;

pulling the fabric to a desired tension; and preventing rotation of the fabric roll about the first mounting post with a tensioning mechanism to maintain the desired tension in the fabric.

17. The method of claim 16, wherein the first clamp is secured to one of a side or a corner of the work surface.

18. The method of claim 17, wherein the second clamp is secured to one of a side or a corner of the work surface.

19. The method of claim 16, wherein the fabric is a sound absorbing fabric.

20. The method of claim 16, comprising the step of installing a sound absorbing panel to the fabric with the fabric extending between the first mounting post and the second mounting post.

21. The method of claim 16, wherein preventing rotation of the fabric roll comprises:

aligning a first plurality of geared teeth on one of a mounting bracket secured to the first clamp or an external surface of the first mounting post with a second plurality of geared teeth on an internal surface of the inner tube; and positioning the inner tube on the first mounting post such that the first plurality of geared teeth engage the second plurality of geared teeth.

22. The method of claim 16, wherein the end of the fabric is secured to the second mounting post with at least one of a clamp, a clip, hook and loop typo fastener, a pinned button, or a magnet.

23. The method of claim 16, wherein:

the first mounting post is secured to the first clamp such that the first mounting post is positioned at a non-perpendicular angle to an upper surface of the work surface without tension placed on the first mounting post by the fabric and is positioned perpendicular to the upper surface of the work surface with tension placed on the first mounting post by the fabric; and the second mounting post is secured to the second clamp such that the second mounting post is positioned at a non-perpendicular angle to the upper surface of the work surface without tension placed on the second mounting post by the fabric and is positioned perpendicular to the upper surface of the work surface with tension placed on the second mounting post by the fabric.

24. The method of claim 16, comprising the steps of:

securing a third clamp of a third mounting assembly to the work surface, the third mounting assembly including a third mounting post secured to the third clamp; and extending the fabric around the third mounting post between the fabric roll and the second mounting post.

* * * * *